United States Patent [19]

Darrow

[11] 4,314,306

[45] Feb. 2, 1982

[54] SIGNAL-POWERED RECEIVER

[75] Inventor: John O. G. Darrow, Murrysville, Pa.

[73] Assignee: American Standard Inc., Swissvale, Pa.

[21] Appl. No.: 168,861

[22] Filed: Jul. 14, 1980

[51] Int. Cl.[3] ..... B61L 23/16

[52] U.S. Cl. ..... 361/182; 361/172; 246/34 C; 246/34 CT

[58] Field of Search ..... 361/182, 184, 171, 172, 361/203; 246/34 C; 455/343

[56] References Cited

U.S. PATENT DOCUMENTS

| | | | |
|---|---|---|---|
| 3,944,173 | 3/1976 | Moe et al. | 246/34 CT |
| 3,951,364 | 4/1976 | Sibley | 246/34 CT |
| 4,117,529 | 9/1978 | Stark et al. | 361/182 |
| 4,118,750 | 10/1978 | Auer, Jr. et al. | 361/182 |

FOREIGN PATENT DOCUMENTS

| | | | |
|---|---|---|---|
| 650869 | 3/1979 | U.S.S.R. | 246/34 C |

*Primary Examiner*—J. D. Miller
*Assistant Examiner*—L. C. Schroeder
*Attorney, Agent, or Firm*—J. B. Sotak

[57] ABSTRACT

A self-powered receiver including a series resonant circuit tuned to the carrier frequency of a modulated carrier signal. A demodulator for detecting the envelope which switches a switching transistor ON during the mark portions of the modulator carrier signals and switches the switching transistor OFF during the space portions. A parallel resonant circuit is driven by the switching transistor to produce a.c. modulations to be coupled to a full-wave rectifier. The rectified voltage of the rectifier is used to energize an electromagnetic relay.

10 Claims, 1 Drawing Figure

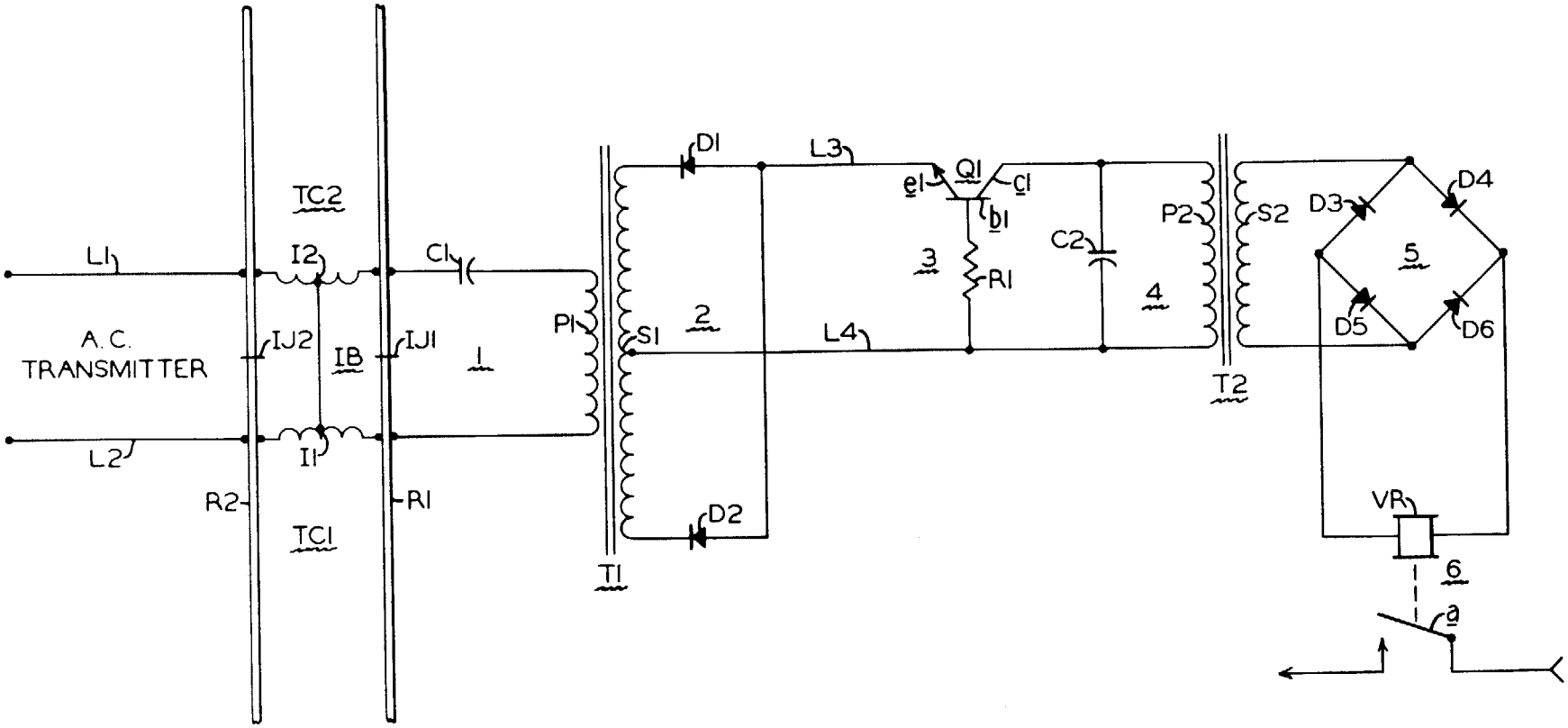
D4
D6
5
D3
D5
S2
T2
VR
6
a
P2
4
C2
C1
b1
R1
Q1
e1
3
L3
L4
D1
2
D2
S1
T1
P1
1
C1
IJ1
R1
TC2
I2
IB
IJ2
I1
TC1
R2
L1
A.C.
TRANSMITTER
L2

SIGNAL-POWERED RECEIVER

FIELD OF THE INVENTION

This invention relates to a signal-powered receiving circuit and, more particularly, to a signal-energized receiver employing a carrier tuned circuit, a demodulator, a switching transistor, a modulation tuned circuit, and a rectifier for powering a vital relay with d.c. voltage which is recovered from the modulation of a modulated carrier signal.

BACKGROUND OF THE INVENTION

In certain control systems, such as, occupancy, continuity or insulated joint detection in railroad track circuits, it is common practice to connect an a.c. transmitter at one point and to connect a receiver at another point. Thus, during the absence of a train, a broken rail or a bad insulated joint in the track circuit, the a.c. signals conveyed to the track by the transmitter are picked up by the receiver to signify a safe condition. When there is high electrical interference present in the tracks, such as, that caused by electrical propulsion currents, it is advisable from a security standpoint to take certain precautionary measures. For example, added security against a false and unsafe response of the receiver may be obtained by modulating the a.c. carrier of the transmitter in a simple ON-OFF fashion and by making the receiver only responsive to the correct modulating and carrier frequencies. Additionally, in the interest of safety and wiring considerations, it is advantageous to employ a receiver which is self-excited. That is, it is desirable to have the receiver derive its entire output power from the modulated carrier input signal without using any other external power supply, both to avoid high gain circuits which might be sensitive to noise, and on occasion, to simplify wiring. However, a signal-powered receiver must be efficient in operation in order to minimize the power requirements of the transmitter. The conventional approach of meeting the above requirements was very wasteful of the signal energy which resulted in the need of an excessively powerful transmitter. In practice, the picked up signals are fed to a carrier filter and, in turn, to a demodulator having a capacitor filter. It was necessary to provide a discharge resistor across the capacitor filter in order to allow the voltage to be pulled back down at the end of a modulation ON cycle. A coupling capacitor was interposed between the discharge resistor and a demodulation filter to prevent any demodulation d.c. from entering the modulation filter. It will be appreciated that the immediate discharge resistor not only dissipates an unusual and unnecessary amount of useful energy but also requires the use of the coupling capacitor for isolation purposes.

OBJECTS OF THE INVENTION

Accordingly, it is an object of this invention to provide a new and improved signal-powered receiver.

A further object of this invention is to provide a novel self-excited receiving circuit.

Another object of this invention is to provide an improved modulated carrier receiver which minimizes the power requirement of a modulated carrier transmitter.

Yet a further object of this invention is to provide a unique self-powered receiving circuit which maximizes the amount of energy delivered to a load.

Yet another object of this invention is to provide a new self-excited receiver which reduces the power losses in order to supply the greatest amount of signal power to energize a relay.

Still a further object of this invention is to provide a signal-powered receiver comprising, an input filter for receiving a modulated carrier signal, a demodulator coupled to the input filter for detecting the modulating signal, a switching device connected to the demodulator and being turned ON and OFF by the detected modulating signal, a modulation filter connected to the switching device, and a rectifier coupled to the modulation filter for producing a d.c. output voltage for energizing a load.

Still another object of this invention is to provide a new and improved signal-powered receiving circuit which is economical in cost, simple in design, reliable in operation, dependable in service, durable in use, and efficient in operation.

SUMMARY OF THE INVENTION

In accordance with the present invention, there is provided a self-powered receiver having an input L-C series resonant circuit for receiving a modulated carrier signal which is conveyed to a track circuit. The L-C series resonant circuit is transformer coupled to a full-wave diode demodulator which detects the modulating signal. The diode demodulator is connected to a switching transistor which is turned ON and OFF by the detected modulating signal. The switching transistor is connected to an L-C parallel resonant modulation filter which is transformer coupled to a full-wave bridge rectifier. The bridge rectifier produces a d.c. voltage for energizing a vital electromagnetic relay which signifies the integrity of the track circuit.

BRIEF DESCRIPTION OF THE DRAWING

The foregoing objects and other attendant features and advantages of this invention will become more fully understood from the ensuing detailed description when considered in conjunction with the accompanying drawing, in which:

The single FIGURE is a schematic circuit diagram illustrating the preferred embodiment of the signal-powered receiving circuit of the present invention.

DETAILED DESCRIPTION OF THE INVENTION

Referring now to the single FIGURE of the drawing, there is shown a self-excited or signal-powered receiver which minimizes the internal power losses for decreasing the power requirement of a modulated carrier transmitter. As shown, the signal-powered receiving circuit is connected to a rail R1 of a trackway TW of a railroad or mass and/or rapid transit system. For the purpose of convenience, the receiver is illustrated as being disposed at the respective ends of two adjacent track circuits TC1 and TC2 which are electrically separated by insulative joints IJ1 and IJ2. In practice, the receiver may be used to monitor the electrical condition of the insulative joints to ensure that neither of the joints has broken down. That is, under normal conditions, the insulative joints provide electrical isolation between track circuits TC1 and TC2 for preventing crossover of speed command signals which are conveyed to the respective track rails R1 and R2. As shown, a conventional impedance bond IB including coded signal blocking inductors I1 and I2 provide the necessary circuit path for propulsion currents in electrified territory.

It will be appreciated that modulated carrier signals are produced by a suitable a.c. transmitter (not shown) and are conveyed to the track rail R2 via leads L1 and L2. In practice, a carrier waveform is coded in an ON and OFF manner by a modulating signal to produce the desired modulated carrier signal. It will be seen that the leads L1 and L2 straddle the insulated joint IJ2, namely, lead L1 is connected on the upper side of track circuit TC1 while the lead L2 is connected on the lower side of track circuit TC2. Thus, if the insulative joint IJ2 breaks down, the coded carrier signals produced by the a.c. transmitter are short-circuited. Similarly, the input connections to the receiver are arranged to straddle the insulative joint IJ1 so that a short-circuit of the input of the receiver occurs if and when the insulative joint IJ1 breaks down.

It will be seen that the signal-powered receiver includes an input filter 1, a demodulator 2, a switching device 3, a modulation filter 4, a full-wave rectifier 5, and a load 6.

The input filter 1 is a series resonant circuit including a capacitor C1 and a winding P1 of a transformer T1. As shown, one end of the capacitor C1 is connected to rail R1 on the upper side of the track circuit TC2 while the other end of the capacitor C1 is connected to the upper end of the primary winding P1. The lower end of the primary winding P1 is directly connected to the rail R1 on the lower side of the track circuit TC1. The L-C filter circuit 1 is tuned to the carrier frequency so that the modulated carrier signals are transformer coupled by transformer T1 to the demodulator 2.

The detector or demodulator 2 includes a pair of diodes D1 and D2 to provide full-wave detection of the envelope of the carrier signal. As shown, the cathode of diode rectifier D1 is connected to the upper end of the center-tapped secondary winding S1 of transformer T1 while the cathode of the diode rectifier D2 is connected to the lower end of the secondary winding S1. The anodes of the two diodes D1 and D2 are commonly connected to lead L3 while the center tap of secondary winding S1 is connected to lead L4. The rectified output of the demodulator 2 is connected to the input of the switching device or circuit 3.

It will be noted that the switching device 3 includes an NPN transistor Q1 which has an emitter electrode e1, a collector electrode c1, and a base electrode b1. The emitter electrode e1 is directly connected to the anodes of diodes D1 and D2 via lead L3 while the base electrode b1 is connected to lead L4 via resistor R1. The collector electrode c1 is connected to the upper end of modulator filter 4 which has its lower end connected to lead L4.

The modulation filter is a parallel tuned resonant circuit which includes a capacitor C2 and a primary winding P2 of transformer T2. The resonant circuit 4 is tuned to the modulation frequency or code rate of the modulating signal. The modulating signal is transformer coupled via secondary winding S2 to the a.c. input terminals of the full-wave rectifier 5.

The full-wave rectifier 5 includes a plurality of diodes D3, D4, D5, and D6 arranged as a bridge network. As shown, the cathode of diode rectifier D3 and the anode of diode rectifier D4 are connected to the upper end of secondary winding S2 while the cathode of diode rectifier D5 and the anode of diode rectifier D6 are connected to the lower end of secondary winding S2. The d.c. output terminals of the full-wave bridge rectifier 5 is connected to a coil VR of a vital type of electromagnetic relay which forms the load 6. As shown, the anodes of diodes D3 and D5 are connected to one end of coil VR while the cathodes of diodes D4 and D6 are connected to the other end of coil VR. The electromagnetic relay VR includes a movable contact a which opens or closes a conventional warning circuit or the like.

In describing the operation, let us assume that the circuit is intact and functioning properly and that the insulative joints IJ1 and IJ2 have not broken down so that the track circuit TC1 is electrically isolated from the track circuit TC2. Under this condition, the coded carrier signals generated by the transmitter are conveyed to the track rail R2 and are picked up by the input filter 1 of the receiver from track rail R1. The tuned resonant filter circuit 1 passes the modulating carrier signals but rejects any propulsion currents and noise signals present in the track circuits. The modulated carrier signals are transformer coupled to the demodulator 2 which rectifies or detects the envelope of the carrier waveform. Thus, during the mark or ON portion of carrier signals, the switching transistor Q1 is rendered conductive so that the capacitor C2 of the resonant circuit 4 is charged to the peak potential level of the modulating signal. That is, when the transistor Q1 is turned ON, energy is pumped into the resonant circuit 4 so that its upper end is driven to a negative potential value. Now, during the space or OFF period of the modulated carrier signal, the switching transistor Q1 is rendered nonconductive so that the energy stored in inductor T2 causes current to flow out from the inductive winding P2 and into the capacitor, and the upper end of the resonant circuit 4 is free to swing positive. Thus, the voltage developed across winding P2 induces an a.c. voltage into secondary winding S2. The a.c. voltage induced in winding S2 is rectified by the full-wave bridge rectifying network 5 which energizes the electromagnetic coil VR and results in the opening of contact a to interrupt the warning circuit. It will be appreciated that the transformer T2 has been designed to have a relatively high quality Q so that most of the energy required to drive it is available for energizing the relay VR. Thus, most of the load demand on the secondary winding S1 of transformer T1 is the power required to energize the relay VR since very little power is needed for switching the diodes D1 and D2 and transistor Q1. The load on the secondary winding S1 is reflected to the primary winding P1 by the turns ratio of transformer T1. Thus, looking into the input of the receiver, the source of power, namely, the a.c. transmitter, sees a load which is representative of a parallel-to-series transformation:

$$R_S = X_L^2 / R_P$$

where $R_S$ is the equivalent resistance of a series resonant circuit, $R_P$ is the equivalent parallel resistance of a parallel resonant circuit, and $X_L$ is the reactance of the resonant circuits. Accordingly, the load presented across insulated joint IJ1, which is eventually driven by the a.c. transmitter to the track is inversely proportional to the impedance of the vital relay VR. With the use of a vital relay, the power demand of the signal source and the track current at which the relay operates can be safely determined. Thus, the largest possible portion of the signal energy withdrawn from the rails R1 and R2 by the receiver is applied to the relay VR so that the power requirements of the a.c. transmitter are minimized due to the small losses exhibited by the presently described receiver. It will be seen that the relay VR will remain picked up so long as both of the insulative joints IJ1 and IJ2 are intact to isolate the track circuit TC1 from the track circuit TC2. If either insulated joint IJ1 or IJ2 breaks down and shorts, the transmitter carrier signals are shunted so that the receiver dces not receive any modulated carrier signals. Thus, the coil VR will be deenergized and will cause the contact a to release and close the warning circuit to alert a maintainer or the like of the failure of the insulative joint. Ergo, the electrical condition of the insulative joints is monitored by the receiver, and a breakdown is readily detected to cause a warning signal.

It will be appreciated that various changes, modifications, and alterations may be made by persons skilled in the art without departing from the spirit and scope of the present invention. For example, a PNP transistor may be used in place of the NPN transistor Q1 if the polarities of the diodes is reversed. The bridge rectifier 5 may be replaced by a full-wave rectifier employing only two diodes. It will be appreciated that the receiver may be also used for occupancy, broken rail detection, or other applications. Under such operation, the transmitter is connected across the track rails at one end of the track section while the receiver is connected across the track rails at the other end of the track section. In addition, it will be apparent that various other changes and ramifications may be made to the subject invention and, therefore, it is understood that all modifications, variations, and equivalents within the spirit and scope of the subject invention are herein meant to be encompassed in the appended claims.

Having thus described the invention, what I claim as new and desire to secure by Letters Patent, is:

1. A signal-powered receiver comprising, an input filter for receiving a modulated carrier signal, a demodulator coupled to said input filter for detecting the modulating signal, a switching device connected to said demodulator and being turned ON and OFF by the detected modulating signal, a modulation filter connected to said switching device which is free to swing to the opposite polarity of the modulation cycle during the OFF period, and a rectifier coupled to said modulation filter for producing a d.c. output voltage for energizing a load.

2. The signal-powered receiver as defined in claim 1, wherein said input filter is a series resonant circuit.

3. The signal-powered receiver as defined in claim 1, wherein said demodulator includes a pair of diodes.

4. The signal-powered receiver as defined in claim 1, wherein said switching device is a semiconductive element.

5. The signal-powered receiver as defined in claim 1, wherein said modulation filter is a parallel circuit.

6. The signal-powered receiver as defined in claim 1, wherein said rectifier is a full-wave bridge rectifying network.

7. The signal-powered receiver as defined in claim 1, wherein said load is a vital electromagnetic relay.

8. The signal-powered receiver as defined in claim 1, wherein said input filter is transformer coupled to said demodulator.

9. The signal-powered receiver as defined in claim 1, wherein said modulation filter is transformer coupled to said rectifier.

10. The signal-powered receiver as defined in claim 1, wherein said input filter is an L-C tuned circuit and said modulation filter is an L-C tuned circuit.

* * * * *